US008378822B2

(12) United States Patent
Price et al.

(10) Patent No.: US 8,378,822 B2
(45) Date of Patent: Feb. 19, 2013

(54) CABLE THEFT MONITORING SYSTEM

(76) Inventors: Melvin Price, Heber City, UT (US); James Spillman, Highland, UT (US)

( * ) Notice: Subject to any disclaimer, the term of this patent is extended or adjusted under 35 U.S.C. 154(b) by 739 days.

(21) Appl. No.: 12/492,684

(22) Filed: Jun. 26, 2009

(65) Prior Publication Data

US 2010/0328072 A1 Dec. 30, 2010

(51) Int. Cl.
*G08B 13/14* (2006.01)

(52) U.S. Cl. ..... 340/568.3; 340/568.1; 340/687; 340/545.2; 340/571

(58) Field of Classification Search ..... 340/568.3, 340/568.1, 687, 635, 545.2, 571
See application file for complete search history.

(56) References Cited

U.S. PATENT DOCUMENTS 4,144,530 A 3/1979 Redfern
4,731,810 A 3/1988 Watkins
4,864,236 A 9/1989 Gibson et al.
5,225,806 A 7/1993 Stanley-Arslanok et al.
5,289,158 A * 2/1994 Neves ..... 340/309.9
5,541,578 A 7/1996 Lussey
5,650,773 A 7/1997 Chiarello
5,973,604 A 10/1999 Eslambolchi et al.
6,034,611 A * 3/2000 Brooks et al. ..... 340/647
6,150,940 A 11/2000 Chapman et al.
6,771,739 B1 8/2004 Beamon et al.
6,934,426 B2 8/2005 Rich et al.
2008/0109387 A1 5/2008 Deaver et al.
2009/0066526 A1 * 3/2009 Marshall et al. ..... 340/635

* cited by examiner

*Primary Examiner* — Jennifer Mehmood
*Assistant Examiner* — Hongmin Fan
(74) *Attorney, Agent, or Firm* — Schmeiser, Olsen & Watts LLP

(57) ABSTRACT

There is a cable theft monitoring system and method configured to protect electrical cables from theft during non-operation hours. The system includes a power circuit configured to provide power. The system also includes a motor coil configured to receive and utilize power. The system further includes a power supply line configured to facilitate power conduction through the motor coil. The system includes a sensor module configured to monitor a characteristic of the power supply line. The sensor module is configured to send an electrical current through the power supply line to the motor coil to detect electrical connection thereto. The system additionally includes an onsite control module configured to provide onsite controls to the cable theft monitoring system. The system also includes an isolation module configured to isolate the sensor module from strong power sources. Furthermore, the system includes a communication module configured to transmit information.

8 Claims, 6 Drawing Sheets

CABLE THEFT MONITORING SYSTEM

BACKGROUND OF THE INVENTION

1. Field of the Invention

The present invention relates to monitoring systems, specifically a cable theft monitoring system.

2. Description of the Related Art

Companies in the Asphalt, Concrete, Sand and Gravel, Crushing, Washing, Screening, Surface Mining, Underground Mining and other similar industries, have suffered greatly in the past due to theft of their power cables. These industries use copper cables to run motors and controls for their plants. The cables can vary in size from small enough to run a switch to large enough to power large horse-power motors. A single plant or operation may have thousands of feet of such cables and operation depends on every cable being in place and functioning properly.

Prices of these cables can vary from $0.75 per foot to over $50.00 per foot depending on the price of copper as a commodity and the diameter of the cable. These cables are often specialized and specifically approved for use in the industry and therefore expensive to replace. They are most often visible and accessible because they are suspended on utility poles or tied along equipment frames to lying on the ground.

The scrap price paid for copper in any market and any economy, makes this a highly sought after material, and leaves owners vulnerable to theft. Most often these thefts occur when plants and mines are shut down and idle during after hour non-working shifts, during weekends and holidays. Many projects use power that is generated on site so that when the generator is not functioning during non-work times there is no power in any of the cables. Therefore, the risk of electric shock when cutting the cable is virtually non-existent. If utility power is used the cables are almost always left with no power on during non-work times for cost and safety purposes. If for some reason power to any cable is left on during non-working times, then simply turning off a well labeled main disconnect or breaker will generally render an entire plant susceptible to easy wire theft.

The wire theft is often accomplished by cutting exposed wires with metal saws or cutters designed for normal cutting of wire during installation. The wire is often thrown into the back of trucks and driven from the crime scene to a location where it is stripped of all insulation. The wire is then taken to any metal recycler and is exchanged for a recycle price based on weight. Sometimes the thieves are employees of the operation.

Operations may have to be suspended for days or weeks as repairs and replacement cables are brought in and installed. Equipment and sensitive electronics may also be damaged depending on the method thieves use to remove the cabling. Therefore, companies are very motivated to protect their facilities and prevent cable theft.

Companies have installed security cameras to monitor plants during non-work periods. The cameras can record activity based on any movement within the field or view. The problems with this method are cameras are exposed to outside elements—wind, rain, snow, sleet, cold temperatures, high temperatures, and high humidity. These elements cause nuisance recordings, failures, dirty lenses, component damage. Recordings often only show that a theft did occur. No one is notified and often times a returning customer can only view how the theft was accomplished. The quality of the recording is not sufficient enough to get license numbers, identifying characteristics of people or even descriptions on vehicle. Banks use some of the best surveillance camera systems available, but thieves rob them all the time because they know that even in the best conditions, it is very difficult to identify them. A person cutting cable several hundred feet from the nearest camera in not concerned at all.

Companies have also hired security personnel or security companies to be on site during all non-working periods. The cost however can be more than five thousand dollars per month. Even with security personnel, often these construction or mine sites are very large and thefts can still occur. Patterns of guard duty or areas of difficult lighting or blocked visions are susceptible. There is still a human element that can cause failure even to the extent of an inside theft ring.

Security systems are typically employed in residential and urban commercial settings where it is important to prevent and detect intrusion. Some improvements have been made in the field. Examples of references related to the present invention are described below, and the supported teachings of each reference are incorporated by reference herein:

U.S. Pat. No. 5,973,604 by Eslambolchi, et al. discloses that lightning strikes on or proximate to an optical fiber cable may be detected via a lightning detector (18) that monitors the characteristics of voltage present on a metallic sheath (12) associated with the cable. The lightning detector (18) detects excessive voltage levels, spikes and/or frequency variations associated with a lightning strike and generates an alarm signal communicated to a central monitoring facility.

U.S. Pat. No. 6,934,426 by Rich, et al. discloses a fiber optic security sensor cable and system for using the cable. The cable includes a optical fiber encased in a first jacket, a power cable encased in a second jacket, and an overjacket encasing both the first jacket and the second jacket where the fiber is utilized to securely transmit data and provide a response to a sensed disturbance to the sensor cable. The system provides secure data transmission and power distribution via the sensor cable where one optical sensing fiber along the path of a data fiber responds to a sensed disturbance to the sensor cable. The system's sensor cable is enabled to detect disturbances at a processing unit where the sensor cable is either physically routed adjacent to the processing unit or within the processing unit. The system can further include more than one processing unit in the form of auxiliary units such as repeaters, power amplifiers, power outlets, data routers, and any similar electronic device. The system can also include a plurality of processing units which are arranged along the data path, wherein the sensor cable is physically routed within at least one of the processing units. The system's processing units may include at least one that is a microprocessor based signal processor.

U.S. Pat. No. 6,150,940 by Chapman, et al. discloses an anti-theft power cord for use with electrical devices has sensors for detecting removal of the cord from an electrical receptacle and for detecting the removal of the cord from the device sought to be protected. Control systems associated with each of the sensors activate alarms when receiving signals from the sensors. The control systems, comprising microcontrollers, also communicate with one another along the power cord and will sound an alarm if the cord is cut. A battery backup system is provided to allow the power cord to function as an anti-theft device even during a power failure without sounding false alarms.

U.S. Pat. No. 4,731,810 by Watkins discloses a backup security system for the telephone company lines of a protected home located in a neighborhood in which all the homes have a.c. supply lines connected to a common power transformer. The protected home, in addition to being provided with a conventional security system, is provided with a line-cut monitor, a PWM transmitter, and a conflict avoidance circuit. When the line-cut monitor senses that the telephone company lines for the protected home have been cut by an intruder, it provided a signal for gating an alarm signal from the conventional security system to the PWM transmitter which impresses the alarm signal as high frequency signals on the a.c. supply lines in the neighborhood. A neighboring home in the neighborhood is provided with a PWM receiver, telephone company lines and an automatic telephone communicator. The PWM receiver in the neighboring home responds to the high frequency signals on the a.c. supply lines and provides a digital signal to the automatic telephone communicator causing it to seize the telephone company lines for the neighboring home and send a message informing a central station that an intruder has broken into the protected home. The conflict avoidance circuit in the protected home enables the PWM transmitter therein to impress high frequency signals on the a.c. supply lines in the neighborhood only when there is an absence of any other high frequency signals on the a.c. supply lines in the neighborhood.

The inventions heretofore known suffer from a number of disadvantages which include being ineffective, being inefficient, being too expensive, being limited in application, being limited in adaptability, being burdensome to use, and being unreliable.

What is needed is a cable theft monitoring system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available a cable theft monitoring system.

According to one embodiment of the invention, there is a cable theft monitoring system configured to protect electrical cables from theft during non-operation hours. The system may include a power circuit configured to provide power. The system may also include a motor coil configured to receive and utilize power. The system may further include a power supply line, functionally coupled between the power circuit and the motor coil and configured to facilitate power conduction through the motor coil. In addition, the system may include a sensor module functionally coupled to the power supply line and configured to monitor a characteristic of the power supply line. The sensor module may be configured to send an electrical current through the power supply line to the motor coil to detect electrical connection thereto. The sensor module may also include a security module configured to send an alarm notification to an off-site administration module, through a network, to alert of a missing electrical connection. The off-site administration module notifies the security personnel and client of a missing electrical connection through a network. The security module further includes an audio alarm module and a visual alarm module configured to alert intruders of a missing electrical connection.

The system may additionally include an onsite control module, functionally coupled to the sensor module and configured to provide onsite controls to the cable theft monitoring system. The system may also include an isolation module, functionally coupled to the power supply line configured to isolate the sensor module from strong power sources. Furthermore, the system may include a communication module, functionally coupled to the sensor module and configured to transmit information regarding the sensor module. The system may also include a network module, in communication with the communication module, configured to receive information regarding the sensor module.

According to another embodiment of the invention, there is a method of monitoring an electrical current through a power supply line. The method may include the step of sending a signal current through a power supply line coupled to a motor coil. The method may then include analyzing a characteristic of the signal for detection of alteration of the power supply line. The method may also include sending information to an off-site administration module regarding a status of the power supply line. The method may further include isolating the power supply line from an operational power source. In addition, the method may include sending the signal current through the windings of the motor coil. The method may also include sending information to a client regarding the status of the power supply line, through a network. Furthermore, the method may include sending a code to reset the monitoring of the electrical current through a power supply line. The method may additionally include triggering an alarm system when the characteristic of the signal for detection is altered from the power supply line.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
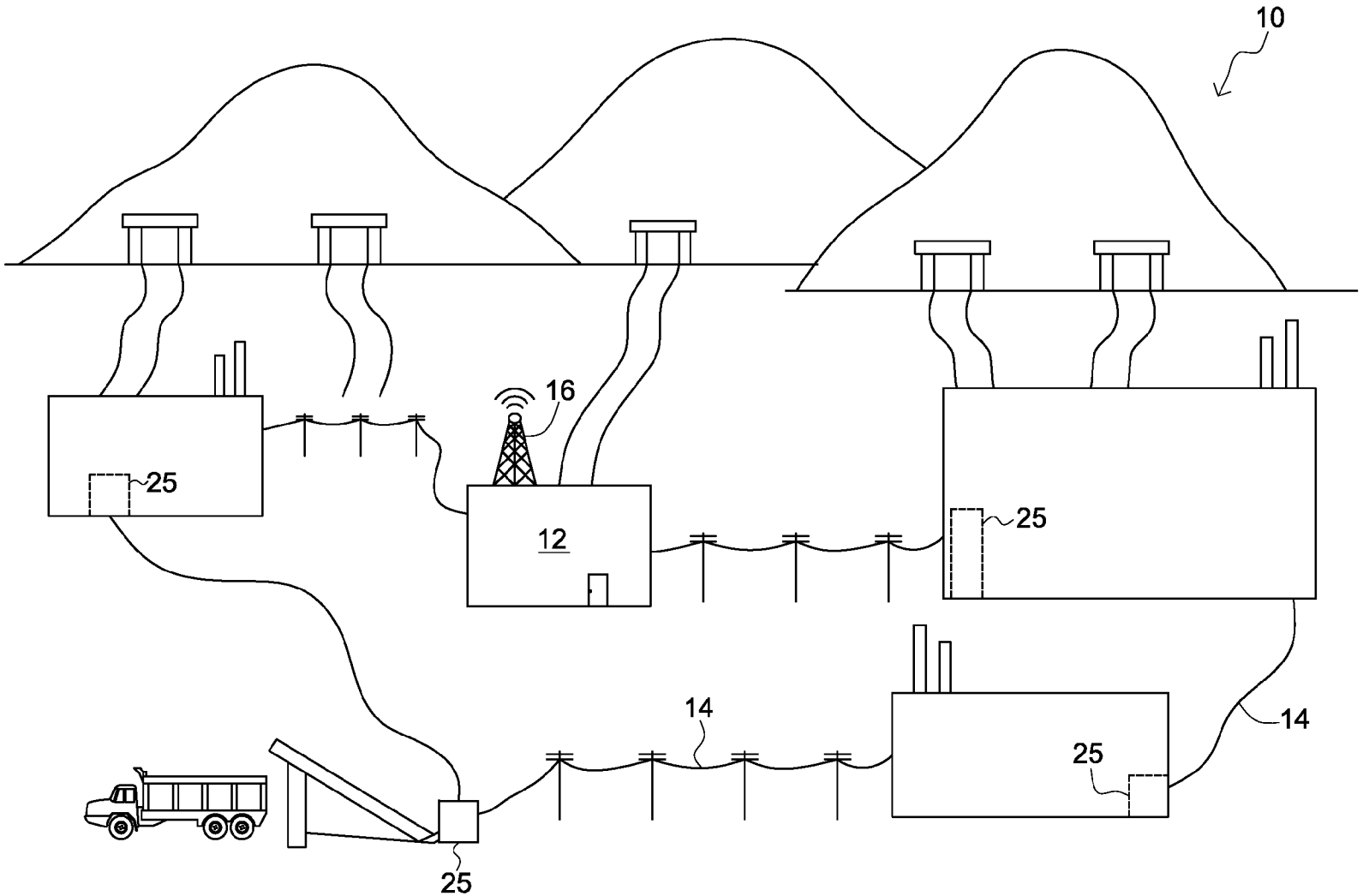
FIG. 1 is a prophetic example of a cable theft monitoring system in the context of a mining operation, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of programmable or executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The various system components and/or modules discussed herein may include one or more of the following: a host server or other computing systems including a processor for processing digital data; a memory coupled to said processor for storing digital data; an input digitizer coupled to the processor for inputting digital data; an application program stored in said memory and accessible by said processor for directing processing of digital data by said processor; a display device coupled to the processor and memory for displaying information derived from digital data processed by said processor; and a plurality of databases. As those skilled in the art will appreciate, any computers discussed herein may include an operating system (e.g., Windows Vista, NT, 95/98/2000, OS2; UNIX; Linux; Solaris; MacOS; and etc.) as well as various conventional support software and drivers typically associated with computers. The computers may be in a home or business environment with access to a network. In an exemplary embodiment, access is through the Internet through a commercially-available web-browser software package.

The present invention may be described herein in terms of functional block components, screen shots, user interaction, optional selections, various processing steps, and the like. Each of such described herein may be one or more modules in exemplary embodiments of the invention. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, the software elements of the present invention may be implemented with any programming or scripting language such as C, C++, Java, COBOL, assembler, PERL, Visual Basic, SQL Stored Procedures, AJAX, extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript or the like.

Additionally, many of the functional units and/or modules herein are described as being "in communication" with other functional units and/or modules. Being "in communication" refers to any manner and/or way in which functional units and/or modules, such as, but not limited to, computers, laptop computers, PDAs, modules, and other types of hardware and/or software, may be in communication with each other. Some non-limiting examples include communicating, sending, and/or receiving data and metadata via: a network, a wireless network, software, instructions, circuitry, phone lines, internet lines, satellite signals, electric signals, electrical and magnetic fields and/or pulses, and/or so forth.

As used herein, the term "network" may include any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), networked or linked devices and/or the like. Moreover, although the invention may be implemented with TCP/IP communications protocols, the invention may also be implemented using IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a prophetic example of a cable theft monitoring system 10, according to one embodiment of the invention. The cable theft monitoring system 10 is configured to protect electrical cables from theft during non-operation hours. The system 10 includes an onsite control module 12, functionally coupled to a sensor module and configured to provide onsite controls to the cable theft monitoring system 10. The system 10 further includes a power supply line 14, functionally coupled between a power circuit and a motor coil 25 and configured to facilitate power conduction through the motor coil 25. Furthermore, the system 10 includes a communication module 16, functionally coupled to the sensor module and onsite control module 12 configured to transmit information regarding the sensor module. A non-limiting example of a sensor module may be a sensor module described in U.S. Pat. No. 4,855,671, issued to Fernandes, which is incorporated for its supported teachings herein.

In operation of one embodiment of the invention, there is a mining and working site having a plurality of electrical cables connecting machinery to working facilities. The electrical cables are disposed above ground and below ground, and vary in size, length, and diameter. The cable theft monitoring system is configured to send an electrical current through the electrical cables to detect a characteristic of the electrical cable. The system sends an electrical current through the electrical cable to the motor coil to detect electrical connection thereto. The electrical current cycles through the motor coil and back through the electrical cable to the cable theft monitoring system. However, if the electrical current does not cycle back to the monitoring system, the communication module sends a notification of the status of the electrical cable to an off-site administration module.

Figure 2:
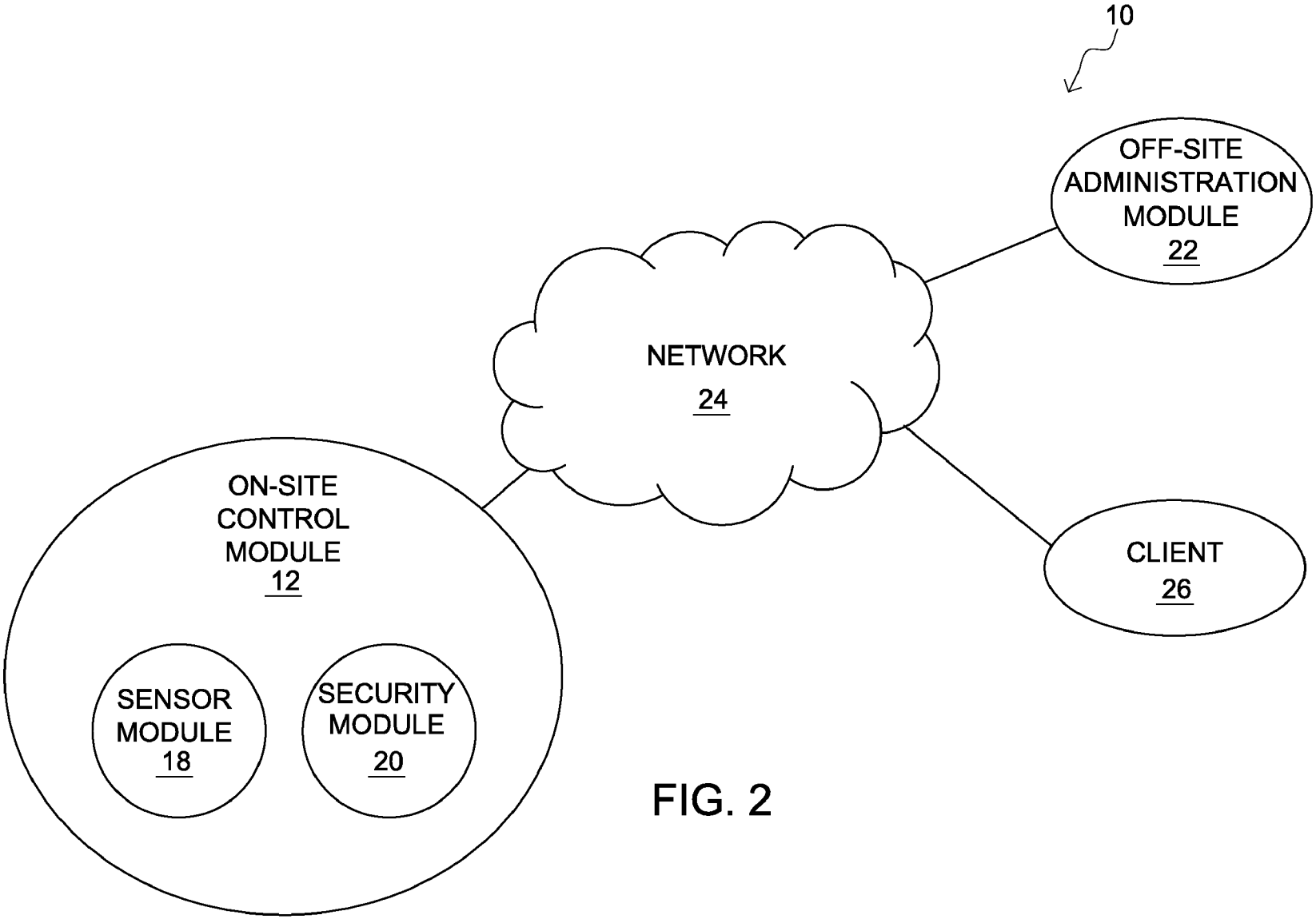
FIG. 2 is a network diagram of a cable theft monitoring system, according to one embodiment of the invention.

FIG. 2 is a network diagram of a cable theft monitoring system, according to one embodiment of the invention. The cable theft monitoring system 10 includes an on-site control module 12 is configured to provide controls to the cable theft monitoring system 10. The on-site control module 12 includes a sensor module 18 functionally coupled to a power supply line and to an onsite control module 12 configured to monitor a characteristic of a power supply line. The sensor module 18 is configured to send an electrical current through the power supply line to the motor coil to detect electrical connection thereto. The system 10 also includes a security module 20 configured to send an alarm notification to an off-site administration module 22, through a network 24, to alert of a missing electrical connection. The off-site administration module 22 notifies the security personnel and a client 26 of a missing electrical connection through the network 24.

In operation of one embodiment of the invention, there is a cable theft monitoring system monitoring an electrical current through a power supply line. The cable theft monitoring system is configured to send an electrical current through the electrical cables to detect a characteristic of the electrical cable through the sensor module. The system sends an electrical current through the electrical cable to the motor coil to detect electrical connection thereto. The electrical current cycles through the motor coil and back through the electrical cable to the cable theft monitoring system. However, if the electrical current does not cycle back to the monitoring system, the security module sends a notification of the status of the electrical cable to an off-site administration module. The off-site administration module sends a notification to a client in regards to the status of the electrical cable.

Figure 3:
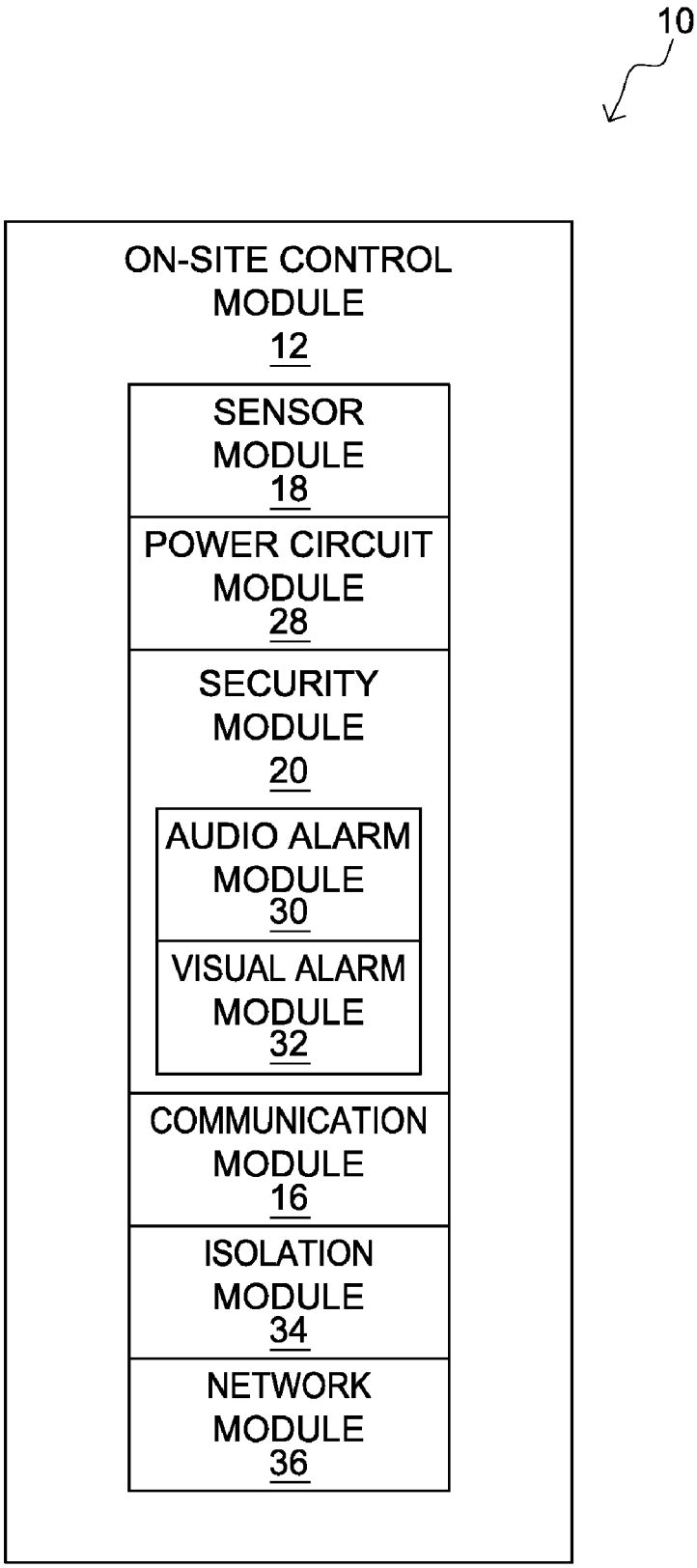
FIG. 3 is a block diagram of an on-site security system of a cable theft monitoring system, according to one embodiment of the invention.

FIG. 3 is a module diagram of an on-site control system of a cable theft monitoring system 10, according to one embodiment of the invention. There is a cable theft monitoring system 10 is configured to protect electrical cables from theft during non-operation hours. The system 10 includes a power circuit module 28 configured to provide power. A non-limiting example of a power circuit module may be a circuit described in U.S. Pat. No. 5,831,467, issued to Leung et al., which is incorporated for its supported teachings herein. The system 10 also includes a motor coil configured to receive and utilize power. The system 10 furthers include a power supply line, functionally coupled between the power circuit and the motor coil and configured to facilitate power conduction through the motor coil. In addition, the system 10 includes a sensor module 18 functionally coupled to the power supply line and configured to monitor a characteristic of the power supply line. The sensor module 18 is configured to send an electrical current through the power supply line to the motor coil to detect electrical connection thereto. The system 10 also includes a security module 20 configured to send an alarm notification to an off-site administration module, through a network, to alert of a missing electrical connection. The security module 20 further includes an audio alarm module 30 and a visual alarm module 32 configured to alert intruders of a missing electrical connection. A non-limiting example of a security module may be a audio/visual alarm system described in U.S. Pat. No. 5,571,210, issued to Kosich, which is incorporated for its supported teachings herein.

Furthermore, the system 10 includes an isolation module 34, functionally coupled to the power supply line configured to isolate the sensor module 18 from strong power sources. The system 10 also includes a communication module 16, functionally coupled to the sensor module 18 and configured to transmit information regarding the sensor module 18 to an off-site administration module. A non-limiting example of a communication module may be a communication module described in U.S. Pat. No. 5,307,463, issued to Hyatt et al., which is incorporated for its supported teachings herein. The system 10 further includes a network module 36, in communication with the communication module 16, and configured to send/receive information regarding the sensor module 18. A non-limiting example of a network module may be a network module described in U.S. Pat. No. 4,866,703, issued to Black et al., which is incorporated for its supported teachings herein.

Figure 4:
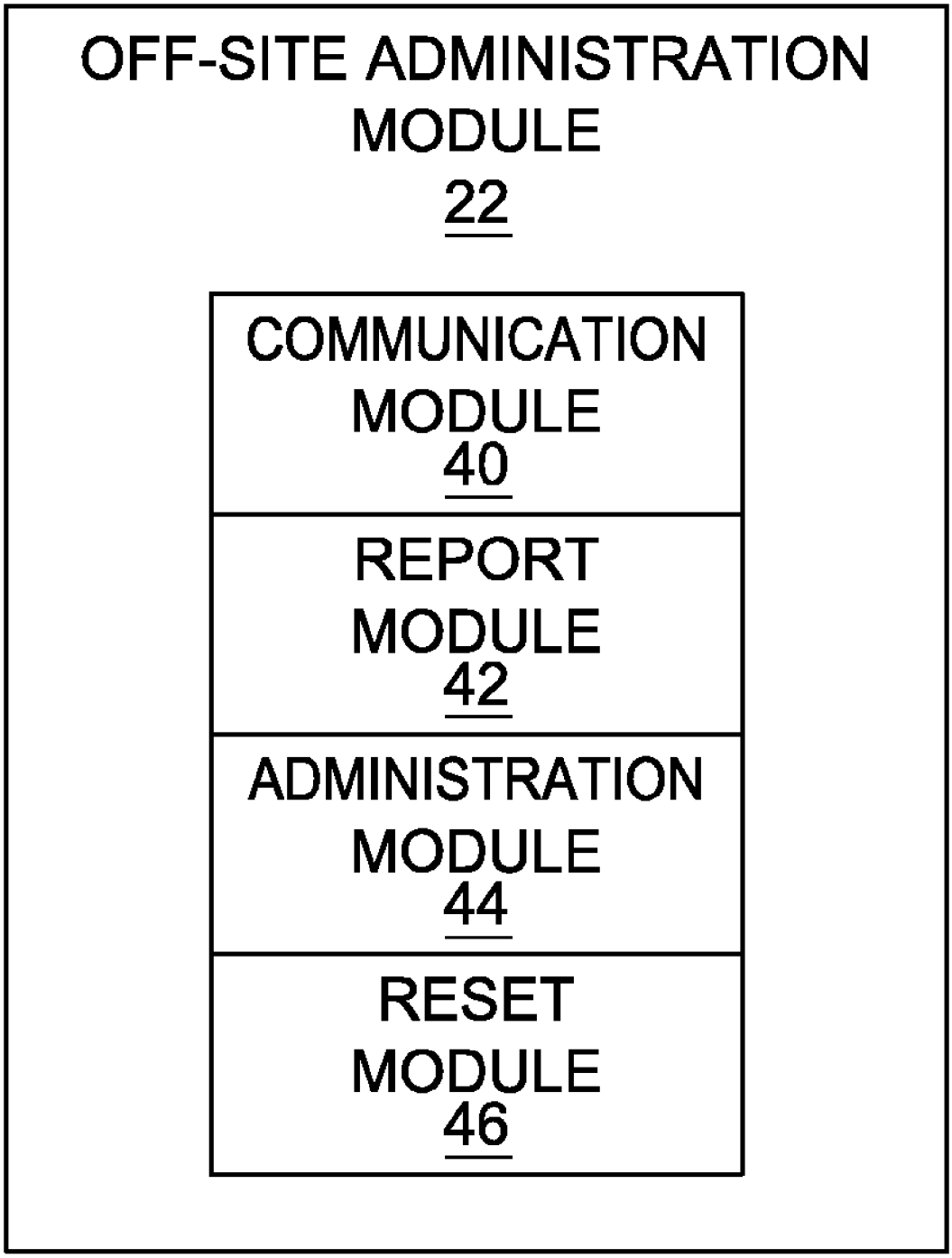
FIG. 4 is a block diagram of a control module of a cable theft monitoring system, according to one embodiment of the invention.

FIG. 4 is a module diagram of an off-site administration module 22 of a cable theft monitoring system 10, according to one embodiment of the invention. There is a cable theft monitoring system 10 configured to protect electrical cables from theft during non-operation hours. The system 10 includes system includes a sensor module functionally coupled to a power supply line and configured to monitor a characteristic of the power supply line. The sensor module may be configured to send an electrical current through the power supply line to the motor coil to detect electrical connection thereto. The sensor module may also include a security module configured to send an alarm notification to the off-site administration module 22, through a network, to alert of a missing electrical connection. The off-site administration module 22 notifies the security personnel and client of a missing electrical connection through a network. The off-site administration module 22 includes a communication module 40 configured to send/receive information in regards to the status of the sensor module. A non-limiting example of a communication module may be a communication module described in U.S. Pat. No. 5,307,463, issued to Hyatt et al., which is incorporated for its supported teachings herein. The off-site administration module 22 includes a report module 42 configured to record the status of the power supply line. A non-limiting example of a report module may be a report system described in U.S. Pat. No. 5,262,943, issued to Thibado et al., which is incorporated for its supported teachings herein. In addition, the off-site administration module 22 includes an administration module 44 configured to provide administrative controls to the on-site control module from a remote location. Furthermore, the off-site administration module 22 includes a reset module 46 configured to reset the settings and monitoring system after a status check. A non-limiting example of a reset module may be a reset module described in U.S. Pat. No. 5,578,112, issued to Krause, which is incorporated for its supported teachings herein.

In operation of one embodiment of the invention, there is a cable theft monitoring system monitoring an electrical current through a power supply line. The cable theft monitoring system is configured to send an electrical current through the electrical cables to detect a characteristic of the electrical cable through the sensor module. The system sends an electrical current through the electrical cable to the motor coil to detect electrical connection thereto. The electrical current cycles through the motor coil and back through the electrical cable to the cable theft monitoring system. However, if the electrical current does not cycle back to the monitoring system, the security module sends a notification of the status of the electrical cable to an off-site administration module. The communication module of the off-site administration module sends a notification to a client in regards to the status of the electrical cable. The off-site administration module stores the status checks in the report module. In addition, the system may be modified or adjusted from a remote location through the administration module of the off-site administration module. Furthermore, the system may be reset from a remote location after the status of the electrical cable has been checked and confirmed.

Figure 5:
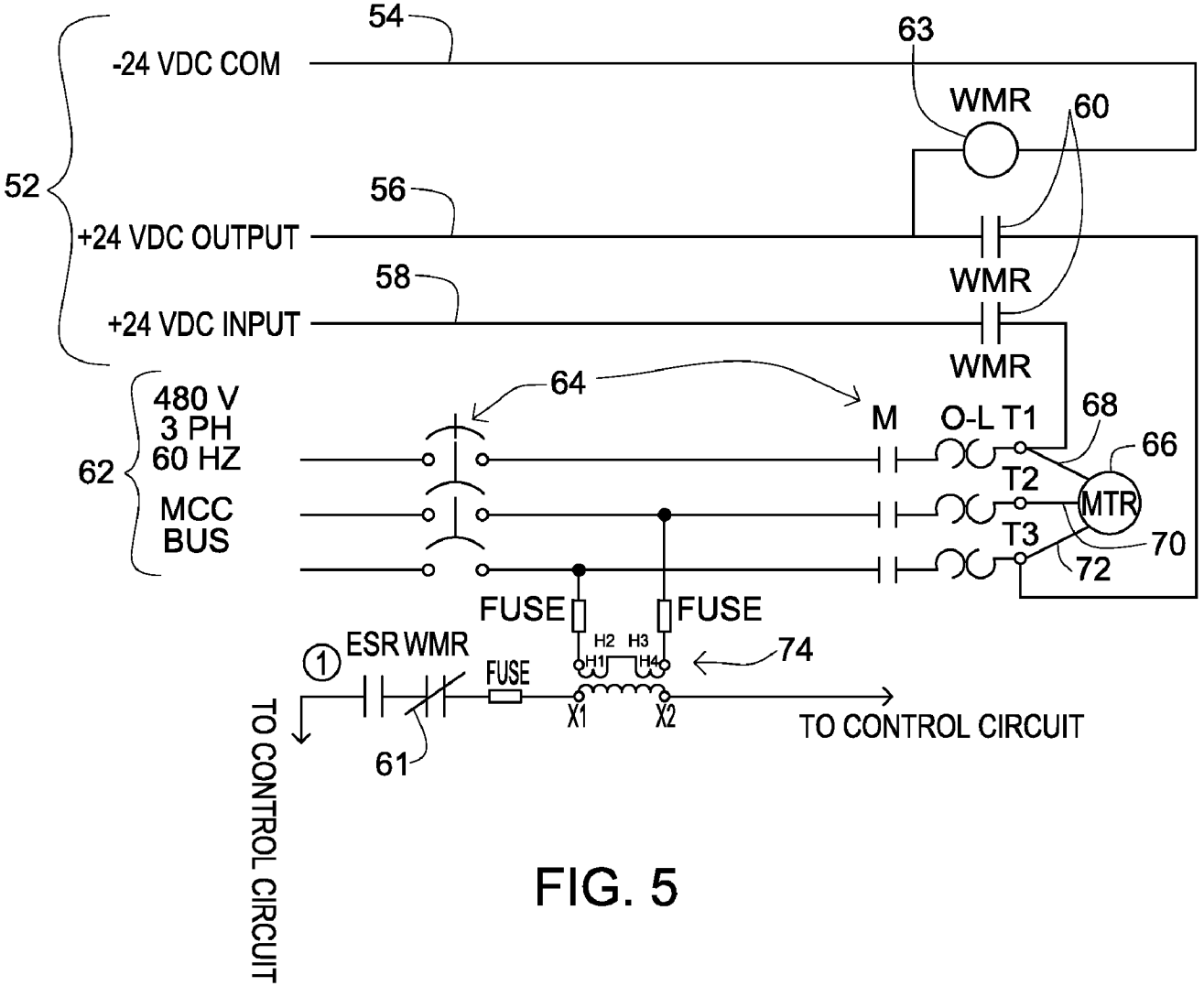
FIG. 5 is a circuit diagram of a control circuit of a cable theft monitoring system, according to one embodiment of the invention.

FIG. 5 is a circuit diagram illustrating portions of an installed cable theft monitoring system coupled to a standard control circuit, according to one embodiment of the invention. There is shown a plurality of signal lines 52, a plurality of power supply lines 62 each electrically coupled to a motor coil 66 by cables 68, 70, and 72 such that power and/or a surveillance signal may be selectably propagated through the cables and motor coil according to a desired protocol and the surveillance signal may be observed and alterations in a characteristic or status of the cables and/or motor coil may trigger an alarm or other response.

The illustrated plurality of signal lines 52 is functionally coupled to a signal module and includes a plurality of signal lines 54, 56, and 58 configured to communicate a signal through a cables and a motor coil 66. The illustrated motor coil 66 is coupled to a signal generation module by lines 52 and to a 3-phase AC power supply module by lines 62 (by electric transmission cables 68, 70 and 72). A switch system 64 selectably controls power through the transmission cables 68, 70 and 72 from the power supply module 62, thereby enhancing control when the system is in operation. The illustrated switch system is controlled and monitored by a standard power control circuit (not shown) such as a main PLC through an induction coil 74. Additional control and safety devices (switches, overload relays and etc.) are strategically disposed within the system for similar purposes.

Signal line relays 60 and control line relay 61 are controlled by a master relay 63 such that the signal line relays 60 are closed when the control line relay 61 is open, and vice versa. Accordingly, the master relay 63 protects the signal circuitry when operating power along lines 62 is present and restricts an operators ability to start operations when the signal lines are in operation. In particular, in the illustrated example, the control circuitry is sufficiently disabled when the signal lines are in operation such that it is not possible for an appropriate control signal to be sent from the control circuitry to provide operating power to the motor coil without "permission" from the master relay.

In operation, a user controls the system through onsite controls, switches, contacts and the like. Main power from the power supply module 62 is isolated from the system by an isolation module having a plurality of coupled relays. A surveillance signal is propagated through the cables to the motor coil of a particular machine and the return signal is routed to a processor where an alert may be generated and an alert signal triggered based on changes observed by the system in the cable/motor coil system. For example, where the surveillance signal disappears, reduces in strength, or alters in pattern duration or amplitude, such may be indicative of a change in the system resulting from undesired behavior. Such an alert may be provided in a great variety of modes.

Figure 6:
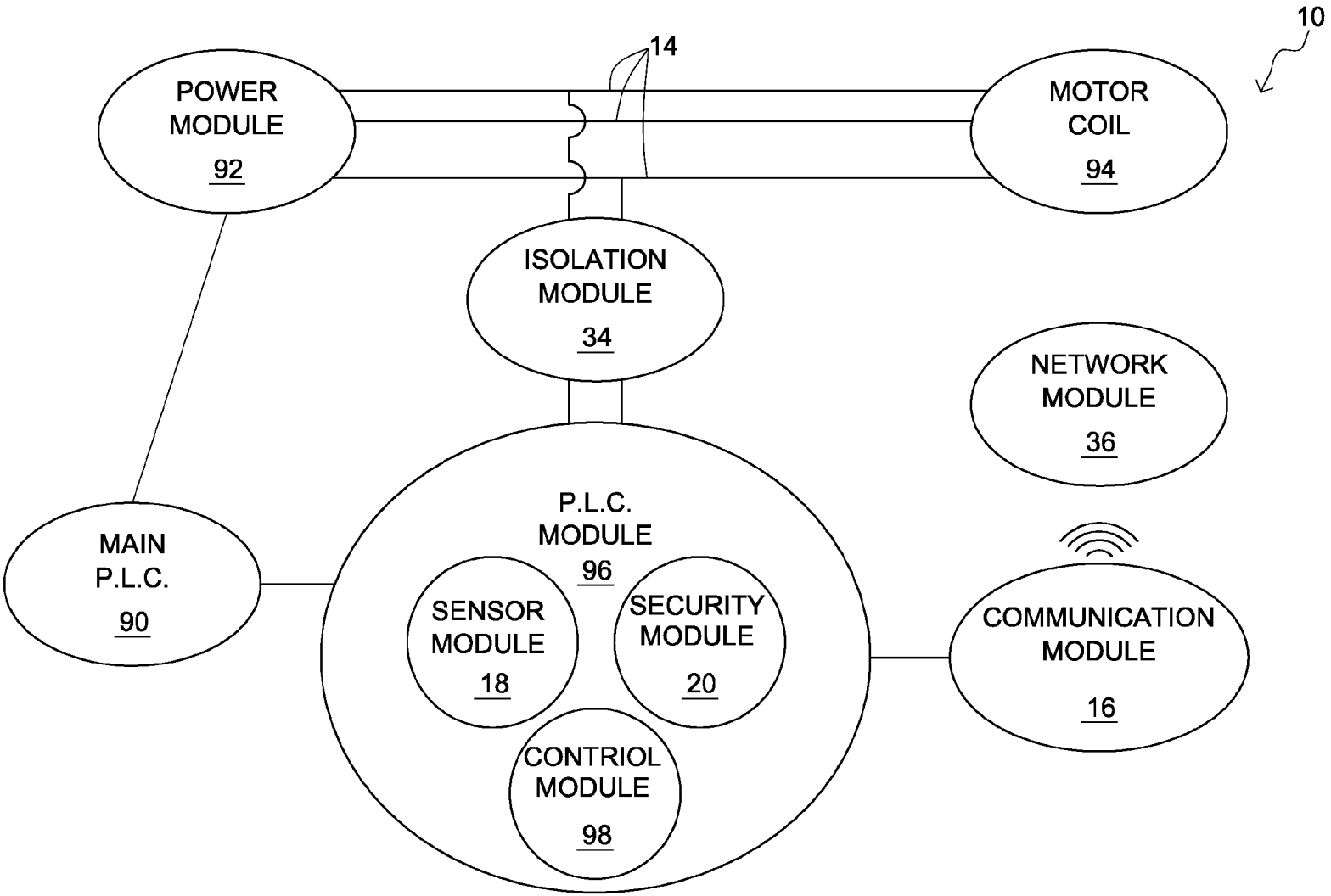
FIG. 6 is a block diagram of a cable theft monitoring system, according to one embodiment of the invention.

FIG. 6 is a block diagram of a cable theft monitoring system, according to one embodiment of the invention. The illustrated cable theft monitoring system 10 includes a plurality of cables 14 to be monitored, a motor coil 94 coupled to the cables, a power module 92 configured to provide operating power to the motor coil through the cables, a main PLC (Programmable Logic Controller) 90 configured to control the power module during operational hours, a PLC module 96 configured to monitor the cables, an isolation module 34 configured to protect the PLC module from the power module, and a communication module 16 configured to communicate information to a network 36.

The illustrated cables 14 are generally large and expensive copper cables that are susceptible to theft, sabotage, and/or tampering. The cables 14 are electrically coupled to the motor coil 94. The motor coil 94 is generally a portion of a motor configured to operate machinery on a job site. Typically there are several motor coils on a job site each with cables 14 running thereto. Each set of cables and/or set of motor coils may be independently monitored. The cables 14 are electrically coupled to a power module 92. The power module 92 may be a generator or other source of power configured to provide operating energy to the motor coil. The power module 92 is generally controlled by a main PLC 90, but may be controlled by another device or system configured to affect the power module 92 and/or the motor coil 94.

The PLC module 96 enables monitoring of the cables and/or motor coils. The PLC module 96 includes a sensor module 18 functionally coupled to cables 14 and configured to monitor a characteristic of the cables 14 and/or motor coil 94, such as but not limited to effective resistance. The sensor module 18 is configured to send an electrical current through the cables 14 to the motor coil 94 and to observe one or more properties of the signal to observe electrical connection thereto. The PLC module 96 also includes a security module 20 configured to send an alarm notification to an off-site administration module as directed by the PLC module, through a communication module 16 to a network module 36, to alert of a missing or altered electrical connection. Furthermore, the PLC module 96 includes a control module 98 configured to provide controls thereto, such as but not limited to manual controls and/or control circuitry that may be remotely or automatically utilized.

The PLC module is in electrical communication with an isolation module 34. The isolation module 34 is functionally coupled to the power supply line 14 and configured to isolate the sensor module 18 from the power module 92. The isolation module may include relays, switches, and/or other devices configured to electrically isolate the power module from the PLC module for the protection thereof.

In operation of one embodiment of the invention, a user controls the system through the main PLC during operational hours. The main power from the power module is isolated from the system, during non-operational hours, by an isolation module that is in communication with a PLC module coupled between the power module and the main PLC. The isolation module cuts off power from the main power module. A sensor module sends a surveillance signal through the cables to the motor coil of a particular machine and the return signal is routed to a security module. The security module sends a report through a communication module to a network module configured to alert an off-site administration module of changes observed by the system in the cable/motor coil system.

According to another embodiment of the invention, there is a method of monitoring an electrical current through a power supply line. The method includes the step of sending a signal current through a power supply line coupled to a motor coil. The method then includes analyzing a characteristic of the signal for detection of alteration of the power supply line. The method also includes sending information to an off-site administration module regarding a status of the power supply line. The method further includes isolating the power supply line from an operational power source. In addition, the method includes sending the signal current through the windings of the motor coil. The method also includes sending information to a client regarding the status of the power supply line, through a network. Furthermore, the method includes sending a code to reset the monitoring of the electrical current through a power supply line. The method additionally includes triggering an alarm system when the characteristic of the signal for detection is altered from the power supply line.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although FIG. 1 illustrates a mining and working site, one skilled in the art would appreciate that the cable theft monitoring system may be utilized in any construction or working site that includes electrical cables and still perform its intended function.

Additionally, although the figures illustrate a single power supply line, one skilled in the art would appreciate that the cable theft monitoring system may be configured to monitor a plurality of power supply lines at any one time and still perform its intended function.

It is also envisioned that one skilled in the art would appreciate that the cable theft monitoring system may be configured to monitor a single power supply line or loop all the power supply lines into a complete cycle, thereby monitoring the entire site all at one time or monitoring a specific power supply line and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A cable theft monitoring system, configured to protect electrical cables from theft during non-operation hours, comprising:

a) a power circuit, configured to provide power; b) a motor coil configured to receive and utilize power; c) a power supply line, functionally coupled between the power circuit and the motor coil and configured to facilitate power conduction through the motor coil;

d) a sensor module functionally coupled to the power supply line and configured to monitor a characteristic of the power supply line;

e) an onsite control module, functionally coupled to the sensor module and configured to provide onsite controls to the cable theft monitoring system;

f) an isolation module, functionally coupled to the power supply line configured to isolate the sensor module from strong power sources;

g) a communication module, functionally coupled to the sensor module and configured to transmit information regarding the sensor module; and h) a network module, in communication with the communication module, configured to receive information regarding the sensor module;

wherein the sensor module further includes a security module configured to send an alarm notification to an off-site administration module through a network to alert of a missing electrical connection;

wherein the isolation module includes a set of oppositely configured relays disposed within signal lines and main control lines such that operational control of the power module is disabled when the signal module is in operation.

2. The system of claim 1, wherein the sensor module is configured to send an electrical current through the power supply line to the motor coil to detect electrical connection thereto.

3. The system of claim 2, wherein the security module further includes an audio alarm module and a visual alarm module configured to alert intruders of a missing electrical connection and wherein the off-site administration module notifies the security personnel and client of a missing electrical connection through a network.

4. A cable theft monitoring system configured to protect power cables, comprising:

a) a plurality of cables configured to be monitored;

b) a motor coil in electrical communication with the plurality of cables;

c) a power module configured to provide operating power to the motor coil, through the plurality of cables;

d) a main PLC configured to control the power module during operational hours;

e) a PLC module configured to monitor the plurality of cables;

f) an isolation module configured to protect the PLC module from the power module; and g) a communication module configured to communicate information to a network module;

wherein the PLC module includes a sensor module functionally coupled to the plurality of cables and configured to monitor a characteristic of the plurality of cables and the motor coil;

wherein the PLC module further includes a security module configured to send an alarm notification through the communication module to the network module, to a user, to alert of a missing or altered electrical connection;

wherein the PLC module further includes a control module configure to provide controls to the PLC module;

wherein the sensor module is configured to send an electrical current through the plurality of cables to the motor coil to detect electrical connection thereto;

wherein the security module further includes an audio alarm module and a visual alarm module configured to alert intruders of a missing electrical connection and notifies a security personnel and a client of a missing electrical connection through a network module;

wherein the isolation module includes a set of oppositely configured relays disposed within the plurality of cables and main PLC such that operational control of the power module is disabled when the PLC module is in operation.

5. A cable theft monitoring system, configured to protect power cables, which are monitored by a programmable logic controller module, when a power module, which is controlled by a main programmable logic controller, is providing operating power, which is from a power module, to a motor coil, comprising:

an isolation module, configured to protect the programmable logic controller module from the power module, and includes:

i) a first relay; and ii) a second relay, configured opposite to the first relay;

wherein the first and second relay are disposed within the power cables and main programmable logic controller, to disable the power module when the programmable logic controller module is in operation.

6. The cable theft monitoring system configured to protect power cables of claim 5, further comprising a communication module configured to communicate information to a network module.

7. The cable theft monitoring system configured to protect power cables of claim 5, wherein the programmable logic controller module includes a sensor module functionally coupled to the plurality of cables and configured to monitor a characteristic of the plurality of cables and the motor coil;

wherein the programmable logic controller module further includes a security module configured to send an alarm notification through the communication module to the network module, to a user, to alert of a missing or altered electrical connection; and wherein the programmable logic controller module further includes a control module configure to provide controls to the programmable logic controller module.

8. The cable theft monitoring system configured to protect power cables of claim 5, wherein the sensor module is configured to send an electrical current through the plurality of cables to the motor coil to detect electrical connection thereto; and wherein the security module further includes an audio alarm module and a visual alarm module configured to alert intruders of a missing electrical connection and notifies a security personnel and a client of a missing electrical connection through a network module.

* * * * *